US005507406A

United States Patent [19]

Urciuoli et al.

[11] Patent Number: 5,507,406

[45] Date of Patent: Apr. 16, 1996

[54] TAMPERPROOF/TAMPER EVIDENT CONTAINER

[75] Inventors: Henry R. Urciuoli, Brea; Robert Urciuoli, Seal Beach, both of Calif.

[73] Assignee: Belford Patrick, Inc., Brea, Calif.

[21] Appl. No.: 419,516

[22] Filed: Apr. 7, 1995

Related U.S. Application Data

[63] Continuation of Ser. No. 233,769, Apr. 26, 1994, abandoned.

[51] Int. Cl.[6] ..... B65D 17/34

[52] U.S. Cl. ..... 220/269; 220/266; 220/307; 215/209

[58] Field of Search ..... 220/276, 307, 220/213, 262, 281, 266, 265, 319, 354, 356, 359, 268, 269, 270; 215/209, 210

[56] References Cited

U.S. PATENT DOCUMENTS

| | | | |
|---|---|---|---|
| 2,765,097 | 10/1956 | Dobson et al. . | |
| 3,142,409 | 7/1964 | Ross . | |
| 3,670,922 | 6/1972 | Phillips . | |
| 4,030,630 | 6/1977 | Yealy . | |
| 4,043,482 | 8/1977 | Brown . | |
| 4,111,329 | 9/1978 | Lampman . | |
| 4,113,136 | 9/1978 | Abbott . | |
| 4,124,141 | 11/1978 | Armentrout et al. . | |
| 4,180,179 | 12/1979 | Hoenig et al. . | |
| 4,332,332 | 6/1982 | Ingemann . | |
| 4,452,382 | 6/1984 | Von Holdt . | |
| 4,474,305 | 10/1984 | Marco | 220/307 |
| 4,488,658 | 12/1984 | Smith et al. . | |
| 4,520,943 | 6/1985 | Nielsen . | |
| 4,572,399 | 2/1986 | Bock . | |
| 4,643,329 | 2/1987 | Mobberley et al. . | |
| 4,711,364 | 12/1987 | Letica | 220/276 |
| 4,742,935 | 5/1988 | Schellenberg | 220/307 |
| 4,759,463 | 7/1988 | Mazoin | 220/270 |
| 4,940,158 | 7/1990 | Farrell et al. . | |
| 4,942,974 | 7/1990 | Larrison . | |
| 5,027,969 | 7/1991 | Lesquir | 220/270 |
| 5,085,339 | 2/1992 | Roth et al. . | |
| 5,129,517 | 7/1992 | Hustad | 206/467 |
| 5,161,711 | 11/1992 | Picozza et al. . | |
| 5,163,575 | 11/1992 | Luch et al. . | |
| 5,170,905 | 12/1992 | Luch | 220/276 |
| 5,249,694 | 10/1993 | Nelson . | |
| 5,303,839 | 4/1994 | Blumenschein . | |
| 5,307,949 | 5/1994 | Von Holdt, Jr. . | |
| 5,398,836 | 3/1995 | Luch et al. | 220/276 |

FOREIGN PATENT DOCUMENTS

| | | |
|---|---|---|
| 2227481 | 1/1990 | United Kingdom . |

*Primary Examiner*—Allan N. Shoap
*Assistant Examiner*—Stephen Cronin
*Attorney, Agent, or Firm*—Sheldon & Mak; Jeffrey G. Sheldon

[57] ABSTRACT

A container and lid combination, typically thermoformed of plastic such as PVC, PS or PET wherein the lid is easily snapped closed onto the container, both initally and resealably, but cannot be removed therefrom without producing visible evidence thereof.

5 Claims, 2 Drawing Sheets

TAMPERPROOF/TAMPER EVIDENT CONTAINER

This is a continuation of application Ser. No. 08/233,769 filed on Apr. 26, 1994, now abandoned.

BACKGROUND

Field of the Invention

This invention is directed to containers including a receptacle and a lid associated therewith, in general, and to such a container wherein removal and/or attempted removal, of the lid from the receptacle provides evidence thereof, in particular.

There are many types of containers known in the art. These vary from boxes to bags to cups with lids and the like.

The containers can be fabricated of virtually any material such as paper, wood and plastic. The plastic devices can be fabricated any number of ways including being thermoformed. Thermoformed plastic containers are generally inexpensive and easy to produce.

In the current day and age, containers are used to store many types of devices for later use and/or sale. Containers can incorporate, among other things, foodstuffs, medicine or the like. Of course, virtually any type of product can be stored in containers with lids.

Unfortunately, in the current day and age it is also a frequent occurrence that containers are tampered with by persons who wish to tamper with the goods or products which are stored in the packages. These attacks on the products have various and sundry effects. For example, the contents of the package or container can be pilfered or contaminated. Pilferage can be a nusiance; contamination can be fatal.

In taking steps to avoid this invasion of the container, many approaches in the nature of security and/or safety have been utilized. Some of these security attempts have been easily circumvented by the persistent person who wishes invade the container and/or its contents. Some of the security measures have been so cumbersome as to make the container virtually useless. Other security measures have been terribly expensive and indirectly driven up the price of the goods contained in the container.

In addition, many of the security attempts have been unsuccessful in that it is not fully evident that the security of the container has been breached. One of the desirable features of security packaging is to have a package which is very secure so as to be considered "tamper proof". Also important is the characteristic that any tampering with the package produces a "tamper evident" condition. With a "tamper evident" condition, a consumer can, with almost casual visual observation, detect that the container has been tampered with even though the "tamper proof" aspects thereof have not been breached.

Consequently, it is highly desirable to produce a package which is relatively inexpensive, easy to produce and is substantially tamper proof and incorporates the characteristics that any tampering is evident to the consumer.

SUMMARY OF THE INVENTION

A container comprising a receptacle and a lid combination are formed of thermoformed plastic such as PVC (polyvinyl chloride), PS (polystyrene) or PET(polyethylene). The components are configured such that the lid is easily snapped closed onto the container, both initially and resealably, but cannot be removed therefrom without producing visible evidence thereof. The receptacle and the lid have sections thereof which nest intimately together to form a seal. The receptacle includes a frangible portion which breaks when the lid is removed.

DESCRIPTION OF A PREFERRED EMBODIMENT

Figure 1:
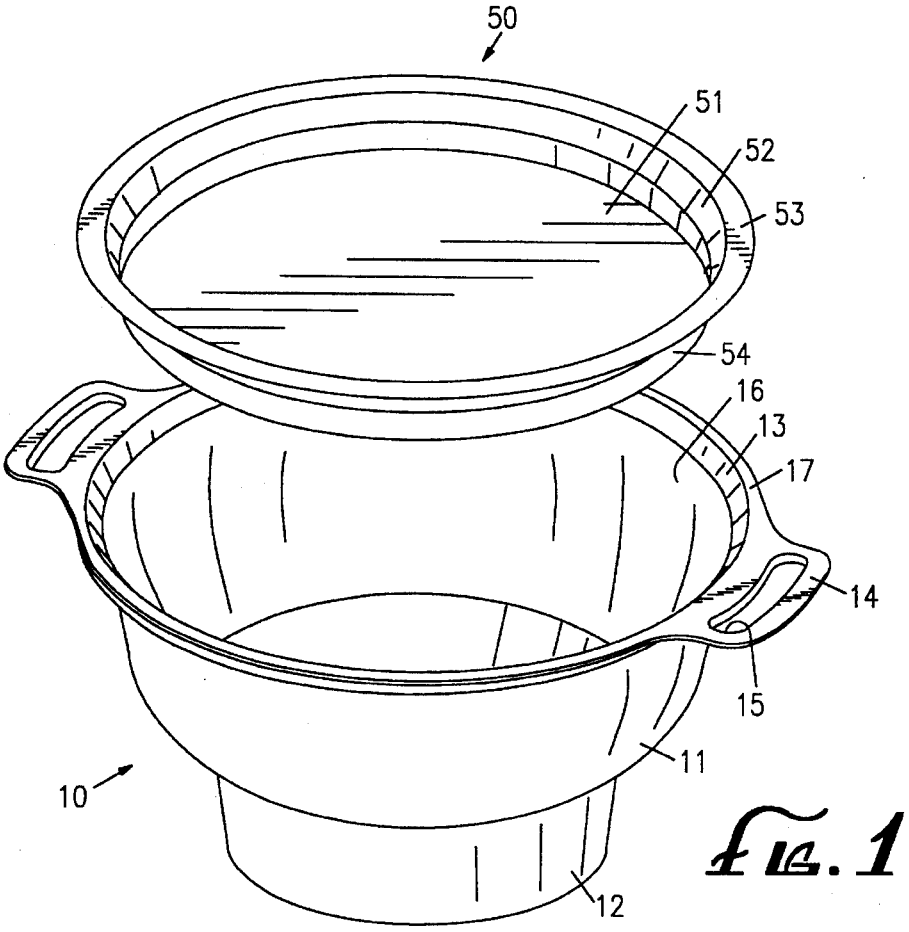
FIG. 1 is a composite view of a receptacle and a lid therefor shown separated from each other.

Referring now to FIG. 1, there is shown a perspective view of a composite container package which includes a receptacle 10 and a lid 50, The receptacle 10 is adapted to receive the lid 50 in a nesting or interlocking arrangement wherein lid 50 is engaged in a locking arrangement with receptacle 10, The specific configurations of the receptacle 10 and the lid 50 (as shown in FIG. 1) are omitted for clarity.

Nevertheless, in FIG. 1 the receptacle 10 is a generally cup shaped configuration, The receptacle 10 includes a generally bowl shaped cup portion 11, A generally cylindrical shaped base 12 is attached to the bottom of the cup portion 11. The inner surface 16 of the cup is shown to be relatively smooth but can take any suitable configuration including flutes or the like to establish a stronger device.

A neck 13 is connected from the cup portion 11 to the upper lip ridge 17. The neck 13 is shown relatively smooth and angled away from the inner surface 16 of cup 11. It should be understood that the neck 13 can have any suitable configuration as will be shown hereinafter. The lip ridge 17 is provided primarily for strength of the receptacle 10.

Attached to the lip ridge 17 (or the upper edge of the neck 13) is handle 14 which extends outwardly therefrom. In this embodiment, an aperture 15 is included in the handle 14 for convenience. The aperture 15 can be a depressed region if so desired.

The lid 50 includes a surface 51 which is used to, effectively, close the receptacle 10. The neck 52 of lid 50 is adapted to have a configuration which is similar to the neck 13 of receptacle 10. A wall 54 fashioned on the lid 50 is generally cylindrical in shape and is adapted to engage the inner surface 16 of the receptacle 10. A lip 53 of the lid 50 is adapted to engage the receptacle 10 in a suitable fashion. Typically, the lip 53 engages a groove (not shown) in the neck 13 of receptacle 10 to form a seal therewith.

It should be understood that the configuration of the receptacle 10 and lid 50 are illustrative only. For example, the receptacle need not be round or even circular. The receptacle can be rectilinear or any other desirable shape. The lid 50 merely reflects the shape of receptacle 10 and is adapted to engage therewith in a sealed (and resealable) fashion.

Likewise, the receptacle 10 as shown in FIG. 1 includes a handle 14 or the like on either side of the receptacle 10. It is not essential to this invention to have multiple handles. Likewise, the aperture 15 can be omitted from the handle 14 if so desired.

In addition, in the embodiment shown and described hereinafter, it is contemplated that the receptacle 10 and lid 50 can be thermoformed of a suitable plastic wherein the components are extremely thin plastic material. However, it is possible that other types of processes and/or materials can be utilized with equal success.

Figure 2:
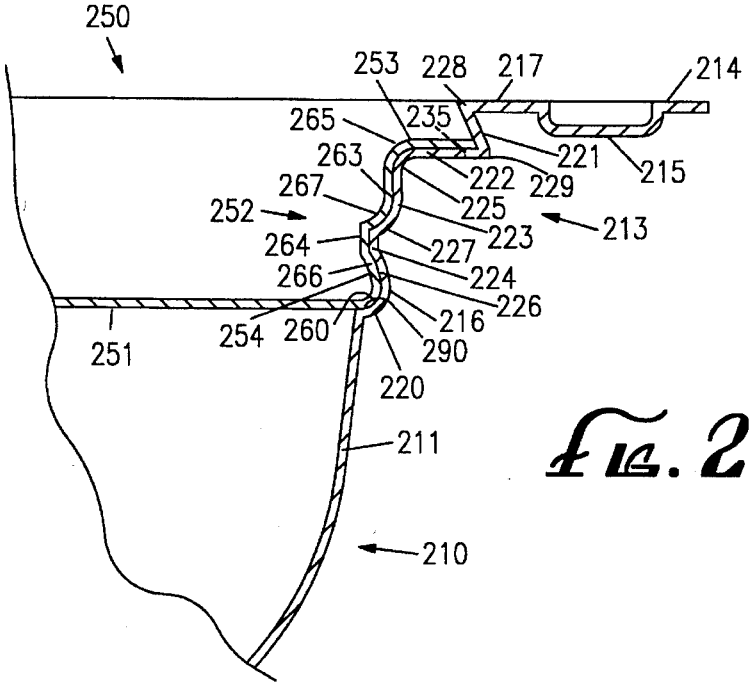
FIG. 2 is a cross-sectional view of a fragmentary portion of one embodiment of a receptacle and lid in accordance with the instant invention.

Referring now to FIG. 2, there is shown a cross sectional view of a fragmentary portion of a receptacle 210 and lid 250 nested together in sealed configuration. Receptacle 210 and lid 250 are a detailed version of one embodiment of receptacle 10 and lid 50 combination as shown in FIG. 1. In particular, the receptacle 210 is shown in a closed configuration with lid 250.

In particular, lid 250 includes the closure surface 251 which spans the opening of receptacle 210. The closure surface 251 is connected to a margin 253 via a neck 252. The margin 253 is, in this instance, a generally horizonally configured rim of the lid 250.

The neck 252 includes a generally upright first portion 254 which is joined to the surface 251 at a corner 260. In this instance, the corner 260 is shown as having a slight radius which is generally easier to produce than a squared off corner.

In a similar fashion, a portion of the neck 252 is generally vertically disposed and is connected in a downwardly fashion from margin 253 to which it is joined as the radius corner 265.

An inwardly directed angled portion at 266 connects the first portion 254 with a vertical second portion 264 which is connected at its other end to a vertical third portion 263 by another radius corner 267.

In this instance, the vertical third and second portions 263 and 254 are slightly offset with the first portion 254 defining a slightly smaller radius (relative to lid 250) than the vertical third portion 263.

The vertical second portion 264 is also offset from the vertical first portion 254 to define a slightly smaller radius (relative to lid 250) than vertical first portion 254. Thus, the neck 252 of lid 250 has a somewhat "serpentine" configuration wherein the vertical second portion 264 and angled portion 266 and radius corner 267 form an indented or notched portion in the neck 252 of lid 250.

Clearly, inasmuch as the lid 250 is, normally, a unit of rotation around the central axis, the notch created by vertical second portion 264 and the associated radii produces a groove around the perimeter of lid.

In the embodiment shown in FIG. 2, the receptacle is shown as having an arcuate body defined by the outer wall 211. The wall 211 is connected to a vertical first segment 216 by a corner radius 220. The corner radius 220 forms an interior ledge 290 on which the corner 260 of lid 250 rests. A vertical second segment 224 is connected to the vertical first segment 216 by a slanted or angled section 226. The other end of vertical second segment 224 is connected to a vertical third segment 223 by a radius 227. The vertical third segment 223 is connected to an outer segment 222 via a radius 225. The outer segment 222 is connected to a generally angulated section 221 by a sharp angle 227 so that the angle 227 and a companion angle connection 228 (at opposite ends of the angulated section 221) are acute angles.

Companion angle connection 228 is formed between the angulated section 221 and a lip 217 which is provided around the outer upper lip of the receptacle 210. This arrangement produces an undercut area between horizontal outer segment 222 and horizontal lip 217.

A suitable handle 214 is shown in this view but may be omitted if desired. In addition, the handle 214 is shown to include a depressed or detented section 215. The portion 215 could be omitted if an aperture in handle 214 is preferred.

As shown in FIG. 2, the neck 252 of lid 250 engages a neck 213 of receptacle 210 in an intimate sealing relation. In particular, the vertical portions first, second, and third segments 254, 264 and 263 of the lid neck 252 abut against the vertical first, second, and third segments 216, 224 and 223 of the neck 213 of the receptacle 210, respectively. In like fashion, the radiused corners or connection points in the respective lid and receptacle also snugly engage one another. In like fashion, the margin 253 of lid 250 engages the outer segment 222 of receptacle 210.

In and of itself, this arrangement can produce a significant seal between lid 250 and receptacle 210. In some instances, this seal can, of course, be substantially water tight.

In addition, the end of margin 253 is adapted to engage the undercut portion of the receptacle neck as defined by the angle 227 formed at the outer edge of outer segment 222 of receptacle 210. This interaction provides a locking mechanism which retains the margin 253 and, thus, lid 250 in contact with the receptacle 210.

In the event that the lid 250 is to be removed from receptacle 210, the handle 214, for example, is bent downwardly (in this Figure) to release the end of margin 253 from the confining undercut angle formed between angulated section 221 and outer segment 222.

As a result, a frangible breakpoint 235 formed in the outer segment 222 is fractured. Thus, this operation of the handle 214 causes the breakpoint 235 to break away from the receptacle 210 wherein any tampering with the receptacle and/or the contents thereof is readily observable.

The breakpoint 235 is shown in dashed line. Typically, the breakpoint 235 is provided in the form of a perforated line, a groove or the like around the receptacle 210 in the outer segment 222. This perforated line is intended to be sufficiently strong to retain lip 217 and handle 214 in the absence of excessive pressure. In the event of pressure on handle 214 and, thus, lip 217, as well as the angulated section 221, the frangible breakaway line is broken or snapped whereupon it is visually obvious that the receptacle has been tampered with.

Figure 3:
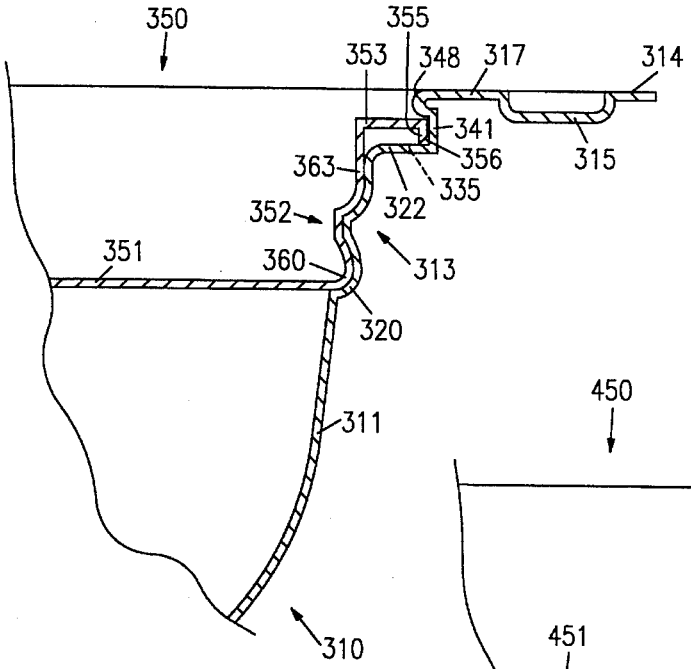
FIG. 3 is a cross-sectional view of a fragmentary portion of another embodiment of a receptacle and lid in accordance with the instant invention.

Referring now to FIG. 3, there is shown a cross sectional fragmentary view of another embodiment of the instant invention.

In this embodiment, similar components bear related reference numerals. For example, lid 350 is inserted into engagement with receptacle 310. A lid neck 352 and the receptacle neck 313 are substantially identical to the neck portions shown and described relative to FIG. 2. The corner 360 (and ledge) is shown in a more squared off arrangement as described supra.

In addition, the lip 317 as well as the handle 314 and the recess 315 of the receptacle 310 are substantially as previously shown.

In the embodiment shown in FIG. 3, however, a vertical third segment 363 extends above an outer segment 322 and is not in contact therewith (see the embodiment shown in FIG. 2). Rather, vertical third segment 363 is joined with the horizontal margin 353 of the lid 350. The margin 353 includes a depending flange or edge 356 which is substantially parallel to the vertical third segment 363. A stub end 357 can be provided at the end of the edge 356 for strength purposes, if so desired. Thus, the perimeter margin 353 of the lid 350 is not in contact with the outer segment 322 of receptacle 310 but is spaced therefrom.

In addition, the connection between lip 317 and outer segment 322 is formed by a vertical member 341 which extends from the outer segment 322 and a curved portion 348 which interconnects the end of the vertical member 341 and one end of the horizontal lip 317. This arrangement defines a space between the upper surface of the outer segment 322 and the bottom surface of the curved portion 348. The vertical edge 356 (with or without stub end 357) of lid 350 is arranged to fit inside this undercut space and to form an interlocking arrangement.

The frangible breakaway line or break point 335 is formed in the outer segment 322 similar to the embodiment shown in FIG. 2. Thus, in order to disengage the margin 353 and edge 356 from the receptacle 310, the handle 314 must be pulled or bent wherein the frangible break point 335 is broken, thus giving evidence of tampering with the device.

Figure 4:
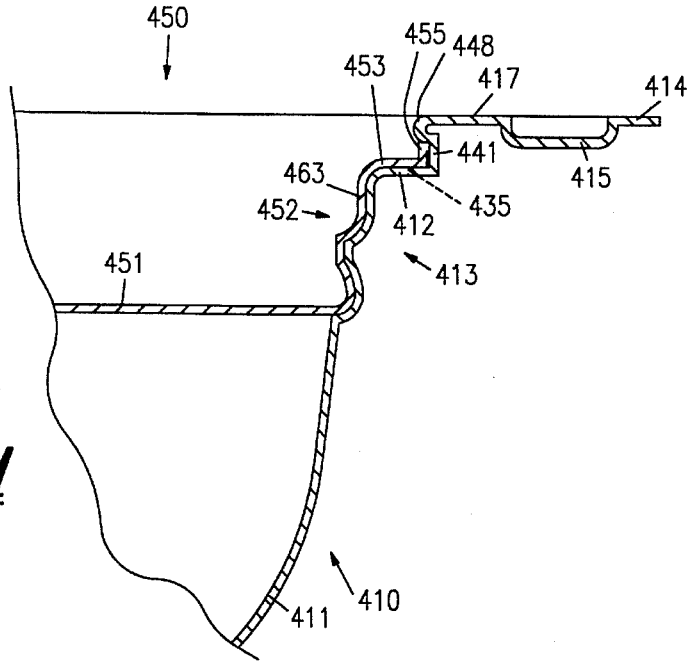
FIG. 4 is a cross-sectional view of a fragmentary portion of another embodiment of a receptacle and lid in accordance with the instant invention.

Referring now to FIG. 4, there is shown another embodiment of the instant invention. Again, similar components bear related reference numerals.

In the embodiment shown in FIG. 4, the neck 452 of lid 450 is substantially the same as shown in the embodiments in FIGS. 2 and 3. Likewise, the neck 413 of FIG. 4 is substantially identical to the neck portion 313 shown in FIG. 3 including the space found adjacent to vertical member 441.

In this embodiment, the vertical third segment portion 463 of the lid neck 452 is connected to a horizontal margin 453 which conforms with the outer segment 422 of the receptacle 410 much the same way as shown in the embodiment of FIG. 2.

In this embodiment an upstanding edge 456 extends upwardly from the end of the margin 453. The edge 456 is adapted to fit into the undercut space defined between the upper surface of the outer segment 422 and the bottom or outer surface of the curved portion 448 adjacent to the lip 417 of the receptacle 410.

The frangible break-point 435 is shown in substantially the same location in the outer segment 422 as in the embodiments shown in either of the preceding Figures. The effect of this frangible break point is to provide the tamper evident aspect of the invention as described supra.

Figure 5:
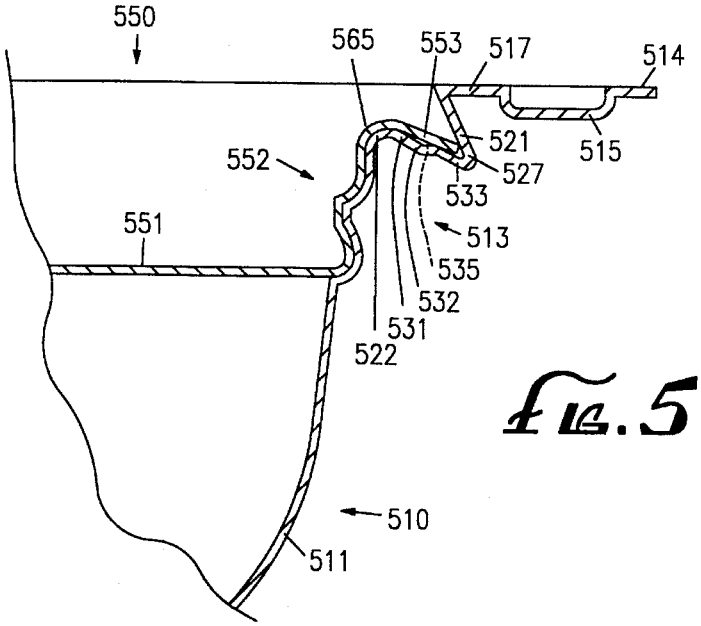
FIG. 5 is a cross-sectional view of a fragmentary portion of another embodiment of a receptacle and lid in accordance with the instant invention.

Referring now to FIG. 5, there is shown yet another embodiment of the instant invention. Once again, the receptacle 510 and lid 550 are similar to those of the counterpart components shown and described relative to the embodiments of earlier Figures. Again, the necks 513 and 552 of the receptacle 510 and lid 550, respectively, are similar to those previously shown and described.

In FIG. 5, the handle 514 and the upper lip 517 are similar to those shown in FIG. 2. However, in FIG. 5, the reverse angle or undercut portion is defined by angulated section 521 which is somewhat longer than the angulated section 221 in FIG. 2. The reverse angle between undercut angulated section 521 and the outer segment 553 is an extremely acute angle. The connecting surface between the vertical third segment 523 and the angulated section 521 comprises a generally serpentine surface. This surface comprises outer surface components 531, 532 and 533. Components 531 and 533 are substantially similar in terms of width and are substantially parallel one to the other. The intermediate component 532 is at an obtuse angle with each of the components 531 and 533 to provide a generally horizontal plane to the outer segment 553. The outer surface component 532 includes the frangible breakpoint 535 in the nature of the other embodiments.

In the embodiment shown in FIG. 5, the radius corner 565 is a generally acute or arcuate connection which substantially conforms to the curved radius 522. The radius corner 565 is connected to the margin 553 of the margin 550. The lid 553 is generally fairly wide and is adapted to nestle into the sharp angle 527 to form an interlocking relationship between the receptacle 510 and the lid 550.

In order to disengage the margin 553 from the sharp angle 527 and angulated section 521, it is necessary to pull or bend the handle 514 which has the effect of fracturing the frangible connection 535 as described supra. Thus, the tamper evident construction is provided.

In addition, it should be noted that each of these embodiments of the invention permit the lid to be reused. That is, the lid can be resealed to the receptacle to maintain the sealed arrangement even after the tamper evident seal has been broken.

Thus, there are shown and described a number of embodiments of the instant invention. In each of these embodiments, a lid fits into intimate engagement with a receptacle. The lid and receptacle thus form a tamper proof conection. In addition, the receptacle includes a frangible portion which is associated with the peripheral lip thereof whereby any disengagement of the lid from the receptacle causes the frangible portion to fracture. Thus, the device becomes a tamper proof, tamper evident package.

Thus, there is shown and described a unique design and concept of a tamper proof/tamper evident receptacle. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

We claim:

1. A resealable, tamper evident container comprising:

(a) a receptacle having an inside volume for holding contents and a removable lid adapted to close the receptacle, the receptacle having, (i) a vertically projecting receptacle neck joining (ii) a horizontally projecting outer segment, the outer segment in turn joined at an acute angle to (iii) a substantially horizontal lip by an inwardly-vertically upward angled section, the outer segment, angled section and lip defining substantially a Z-shape in cross-section, (iv) a handle disposed on the lip, and (v) the receptacle outer segment having a breakpoint proximate the handle adapted to fracture when the handle is forced downward, (b) the lid including, (i) a vertically disposed lid neck having a circumscribed inwardly directed groove adapted to cooperate with the receptacle neck to releasably and resealably secure the lid to the container, and joined to (ii) a substantially horizontal peripheral margin adapted to closely and coextensively overlay the receptacle outer segment when the lid is secured to the container to nest the lid margin in the acute angle defined by the outer segment and angled section, wherein the container is opened by forcing the handle downward and fracturing the breakpoint to evidence tampering and revealing the nested lid margin for removal of the lid from the receptacle.

2. The container of claim 1 wherein the receptacle and lid necks are circular.

3. The container of claim 1 wherein the receptacle neck includes (i) a first vertical segment joined to (ii) a second vertical segment by an inwardly angled section and the second vertical segment is joined by an outwardly directed radius to (iii) a vertical third segment, the second vertical segment releasably and re-sealably received by the lid groove to secure the lid to the receptacle.

4. A resealable, tamper evident container comprising:

(a) a receptacle having an inside volume for holding contents and a removable lid adapted to close the receptacle, the receptacle having, (i) a vertically projecting receptacle neck joining (ii) a horizontally projecting outer segment, the outer segment in turn joined at an acute angle to (iii) a substantially horizontal lip by an inwardly-vertically upward angled section, the outer segment, angled section and lip defining substantially a Z-shape in cross-section, and (iv) a handle disposed on the lip, (v) the receptacle neck having (1) a first vertical segment joined to (2) a second vertical segment by an inwardly angled section and the second vertical segment is joined by an outwardly directed radius to (3) a vertical third segment, and (vi) the receptacle outer segment having a breakpoint proximate the handle adapted to fracture when the handle is forced downward, (b) the lid including, (i) a vertically disposed lid neck having a circumscribed inwardly directed groove adapted to receive the receptacle neck second vertical segment to releasable and re-sealably secure the lid to the container, and (ii) a substantially horizontal peripheral margin adapted to closely and coextensively overlay the receptacle outer segment when the lid is secured to the container to nest in the acute angle defined by the outer segment and angled section, wherein the container is opened by forcing the handle downward to reveal the nested lid margin to pull the lid to release the lid from the receptacle and fracturing the breakpoint to evidence tampering.

5. A resealable, tamper evident container comprising:

(a) a receptacle having an inside volume for holding contents and a removable lid adapted to close the receptacle, the receptacle having to a vertically projecting receptacle neck joined to a means for evidencing tampered opening of the container including, (i) a horizontally projecting outer segment joined to the neck, the outer segment in turn joined at an acute angle to (iii) a substantially horizontal lip by an inwardly-vertical angled section, the outer segment, angled section and lip defining substantially a z-shape in cross-section, (iv) a handle disposed on the lip, and (v) the receptacle outer segment having a breakpoint proximate the handle adapted to fracture when the handle is forced downward, (b) the lid including, (i) a vertically disposed lid neck having a circumscribed inwardly directed groove adapted to cooperate with the receptacle neck to releasable and resealably secure the lid to the container, and (ii) a substantially horizontal peripheral margin adapted to closely and coextensively overlay the receptacle outer segment when the lid is secured to the container to nest in the acute angle defined by the outer segment and angled section, wherein the container is opened by forcing the handle downward to reveal the nested lid margin to allow for removal of the lid from the receptacle and to fracture the breakpoint to evidence tampering.

* * * * *